US007991325B2

(12) United States Patent
Yamaguchi

(10) Patent No.: US 7,991,325 B2
(45) Date of Patent: Aug. 2, 2011

(54) IMAGE FORMING DEVICE HAVING EXPOSURE UNIT PROVIDED TO FIRST DEVICE BODY ROTATABY JOINED TO SECOND DEVICE BODY

(75) Inventor: Takuya Yamaguchi, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 340 days.

(21) Appl. No.: 12/233,780

(22) Filed: Sep. 19, 2008

(65) Prior Publication Data

US 2009/0087209 A1 Apr. 2, 2009

(30) Foreign Application Priority Data

Sep. 27, 2007 (JP) ..... 2007-250858

(51) Int. Cl.
*G03G 21/16* (2006.01)
*G03G 15/04* (2006.01)

(52) U.S. Cl. ..... 399/125; 399/177

(58) Field of Classification Search ..... 399/125
See application file for complete search history.

(56) References Cited

U.S. PATENT DOCUMENTS

| | | | | |
|---|---|---|---|---|
| 2005/0196217 | A1* | 9/2005 | Nishimura et al. | 400/693 |
| 2007/0047028 | A1* | 3/2007 | Hashimoto et al. | 358/498 |
| 2007/0122187 | A1* | 5/2007 | Mase | 399/111 |

FOREIGN PATENT DOCUMENTS

| | | | | |
|---|---|---|---|---|
| JP | 7-314779 | A | | 12/1995 |
| JP | 07314779 | A | * | 12/1995 |
| JP | 2002-311662 | A | | 10/2002 |
| JP | 2003-112446 | | | 4/2003 |
| JP | 2007-065066 | A | | 3/2007 |
| JP | 2007-065125 | | | 3/2007 |

OTHER PUBLICATIONS

JP Office Action dtd Aug. 18, 2009, JP Appln. 2007-250858, English translation.

* cited by examiner

*Primary Examiner* — David M Gray
*Assistant Examiner* — David Bolduc
(74) *Attorney, Agent, or Firm* — Banner & Witcoff, Ltd.

(57) ABSTRACT

An image forming device includes a first device body, a second device body having a first side end and a second side end opposite to the first side end, the first side end being rotatably joined with the first device body, the second side end turning around the first side end between an opened state and a closed state, a photoconductive body provided in the first device body, an exposure unit provided to the second device body, the exposure unit having an exposure surface exposing the photoconductive body and form a latent image on the photoconductive body, and an exposure unit turning mechanism that turns the exposure unit between an exposure position where the exposure surface is directed to the photoconductive body in the closed state and an evacuation position where the exposure surface is directed to the first side end in the opened state.

6 Claims, 13 Drawing Sheets

IMAGE FORMING DEVICE HAVING EXPOSURE UNIT PROVIDED TO FIRST DEVICE BODY ROTATABY JOINED TO SECOND DEVICE BODY

CROSS-REFERENCE TO RELATED APPLICATION

This application claims priority under 35 U.S.C. §119 from Japanese Patent Application No. 2007-250858 filed on Sep. 27, 2007. The entire subject matter of the application is incorporated herein by reference.

BACKGROUND

1. Technical Field

The following description relates to one or more image forming devices such as an electrophotographic copy machine and a printer.

2. Related Art

In an image forming device such as a copy machine and a printer, a laser scanning method and an LED exposure method have been put into practical use as an image writing method (exposure method). The LED exposure method is a method in which light emitted by a light emitting unit with a plurality of light emitting elements linearly aligned is directed onto a surface of a photoconductive body with an imaging system and a latent image is formed on the surface of the photoconductive body.

FIG. 13 schematically shows a configuration of a main portion of a known image forming device when viewed in a direction perpendicular to a carrying direction of a recording medium. The image forming device 101 shown in FIG. 13 is configured to perform color printing. In a device main body 102, four drum units 103 are detachably disposed that correspond to yellow (Y), magenta (M), cyan (C), and black (K), respectively, in an order from an upstream side in an arrow A direction as the carrying direction of the recording medium.

Each of the drum units 103 is provided with a photoconductive drum 103*a* configured to rotate in an arrow B direction. Further, images of the predetermined colors are sequentially transferred onto the recording medium which is conveyed in the arrow A direction while being stuck to a carrying belt (not shown) by the respective photoconductive drums 103*a* in collaboration with respective transfer rollers 104 rotated concurrently with the photoconductive drums 103*a*.

Meanwhile, a stacker cover 107 is rotatably supported by the device main body 102 via a rotational shaft 108 extending in a direction perpendicular to the arrow A direction. Further, the stacker cover 107 holds four LED heads 111 disposed in positions corresponding to circumferential surfaces of the photoconductive bodies 103*a* of the drum units 103, respectively. Thus, the stacker cover 107 is configured to be opened and closed with respect to the device main body 102, and provided such that the drum units can be replaced when the stacker cover 107 is opened with respect to the device main body 102 (for example, see Japanese Patent Provisional Publication No. 2003-112446).

SUMMARY

In the above known configuration, the LED heads 111 are fixed substantially perpendicularly to the stacker cover 107. Therefore, when the stacker cover 107 is opened with respect to the device main body 102, exposure surfaces of the LED heads 111 are exposed to an open side of the stacker cover 107. Thereby, the exposure surfaces might be damaged or tainted with dust adhered thereto.

Aspects of the present invention is advantageous to provide one or more improved image forming devices that can prevent an exposure surface of an exposure unit thereof from being damaged or contaminated with dust adhered to the exposure surface.

According to aspects of the present invention, an image forming device is provided, which includes a first device body having an opening, a second device body having a first side end and a second side end opposite to the first side end, the first side end being rotatably joined with the first device body, the second side end being configured to turn around the first side end between an opened state where the second device body is opened with respect to the first device body and a closed state where the second device body is closed with respect to the first device body so as to cover the opening, a photoconductive body provided in the first device body; an exposure unit provided to the second device body, the exposure unit having an exposure surface configured to expose a surface of the photoconductive body linearly in a predetermined scanning direction and form a latent image on the surface of the photoconductive body, and an exposure unit turning mechanism configured to turn the exposure unit between an exposure position where the exposure surface is directed to the surface of the photoconductive body in the closed state of the second device body and an evacuation position where the exposure surface is directed substantially to the first side end of the second device body in the opened state of the second device body.

In some aspects, when the second device body is in the opened state, the exposure surface of the exposure unit is directed to the first side end of the second device body that is rotatably joined with the first device body. Therefore, since the exposure surface of the exposure unit is not exposed to an open side of the second device body in the opened state, it is possible to prevent an exposure surface of an exposure unit from being damaged or contaminated with dust adhered thereto.

BRIEF DESCRIPTION OF THE ACCOMPANYING DRAWINGS

Figure 6:
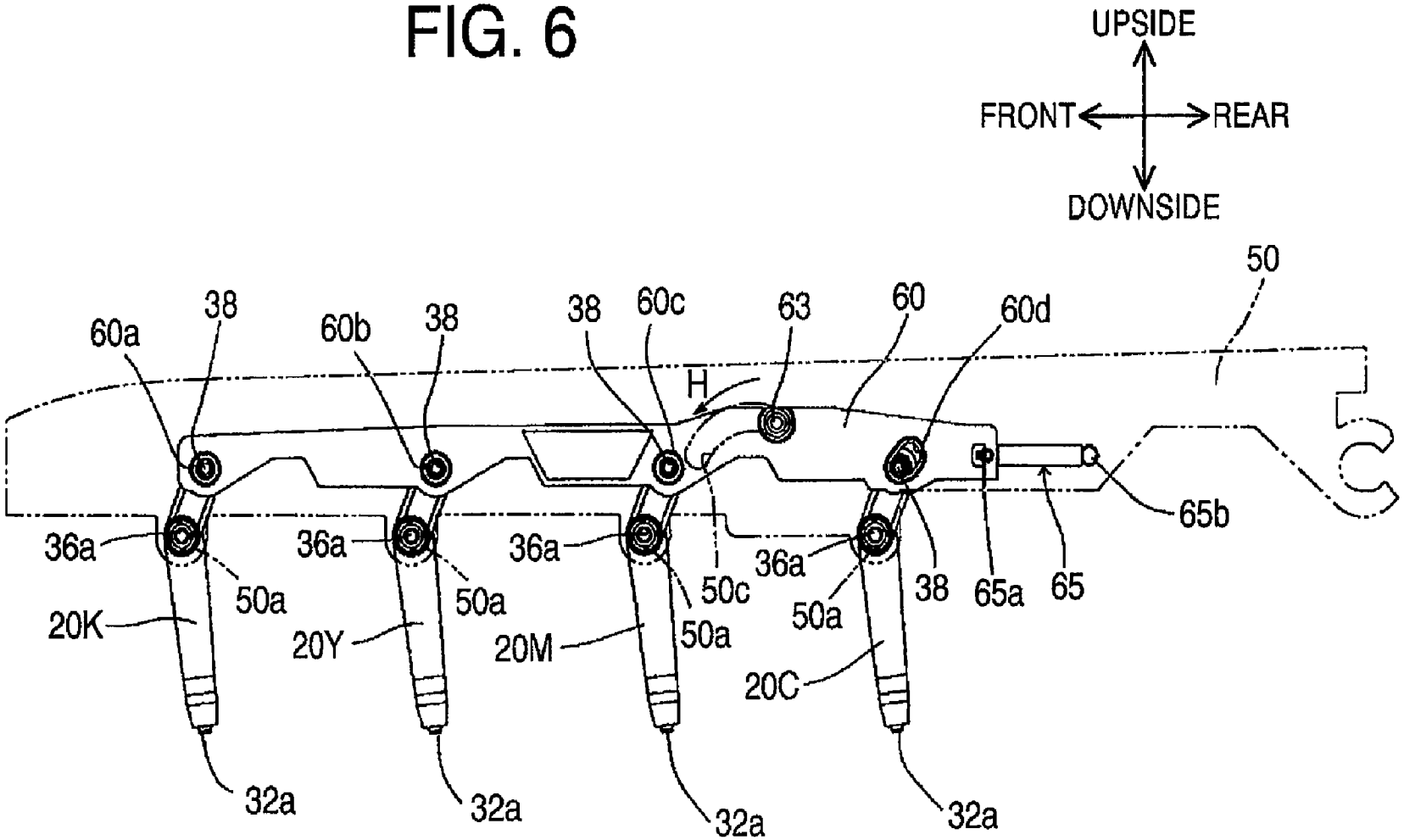

FIG. 6 schematically shows a mechanism for turning the LED unit in the state where the upper case is closed in the embodiment according to one or more aspects of the present invention.

Figure 7:
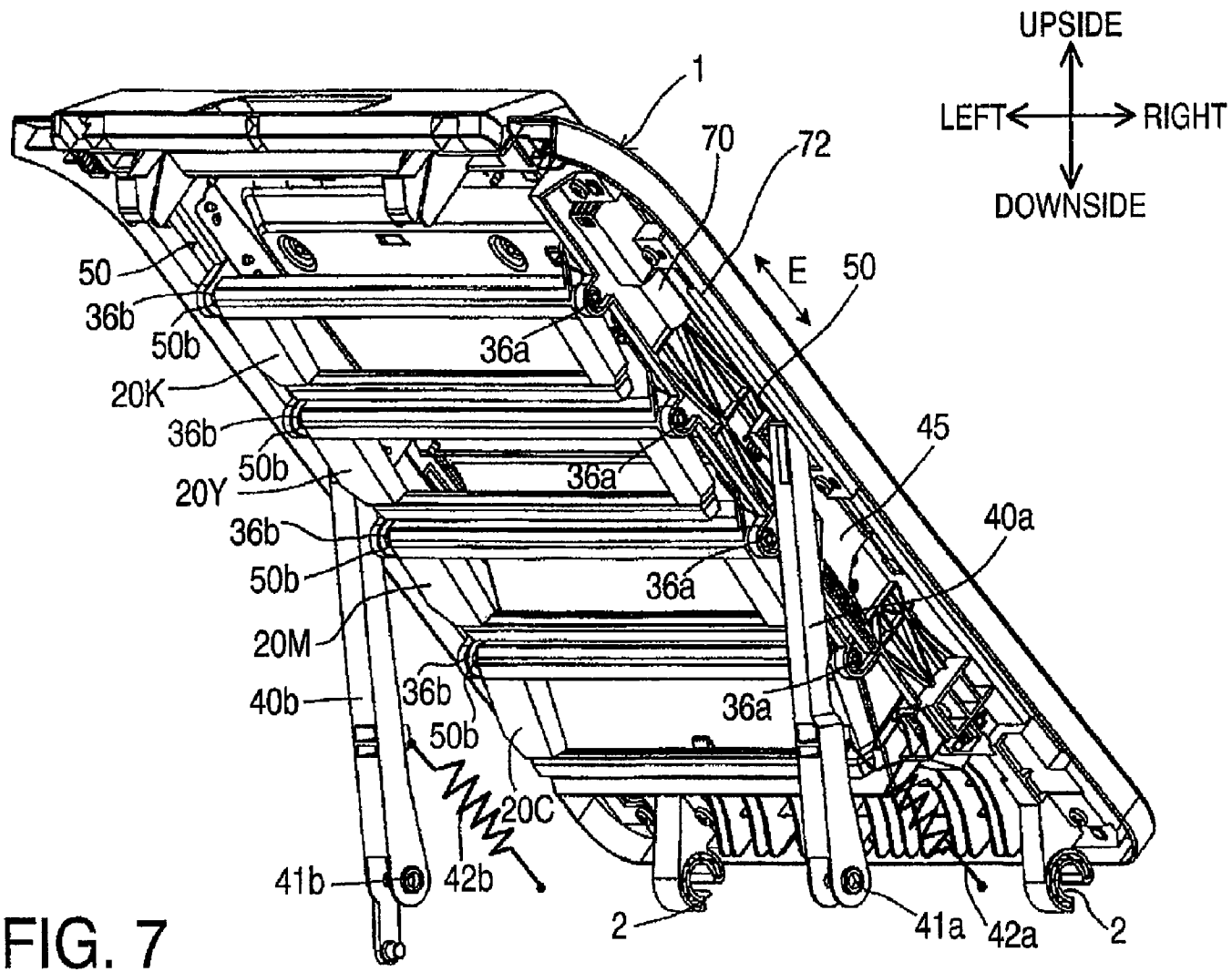

FIG. 7 is a perspective view showing a state where arms support the upper case in the embodiment according to one or more aspects of the present invention.

Figure 8:
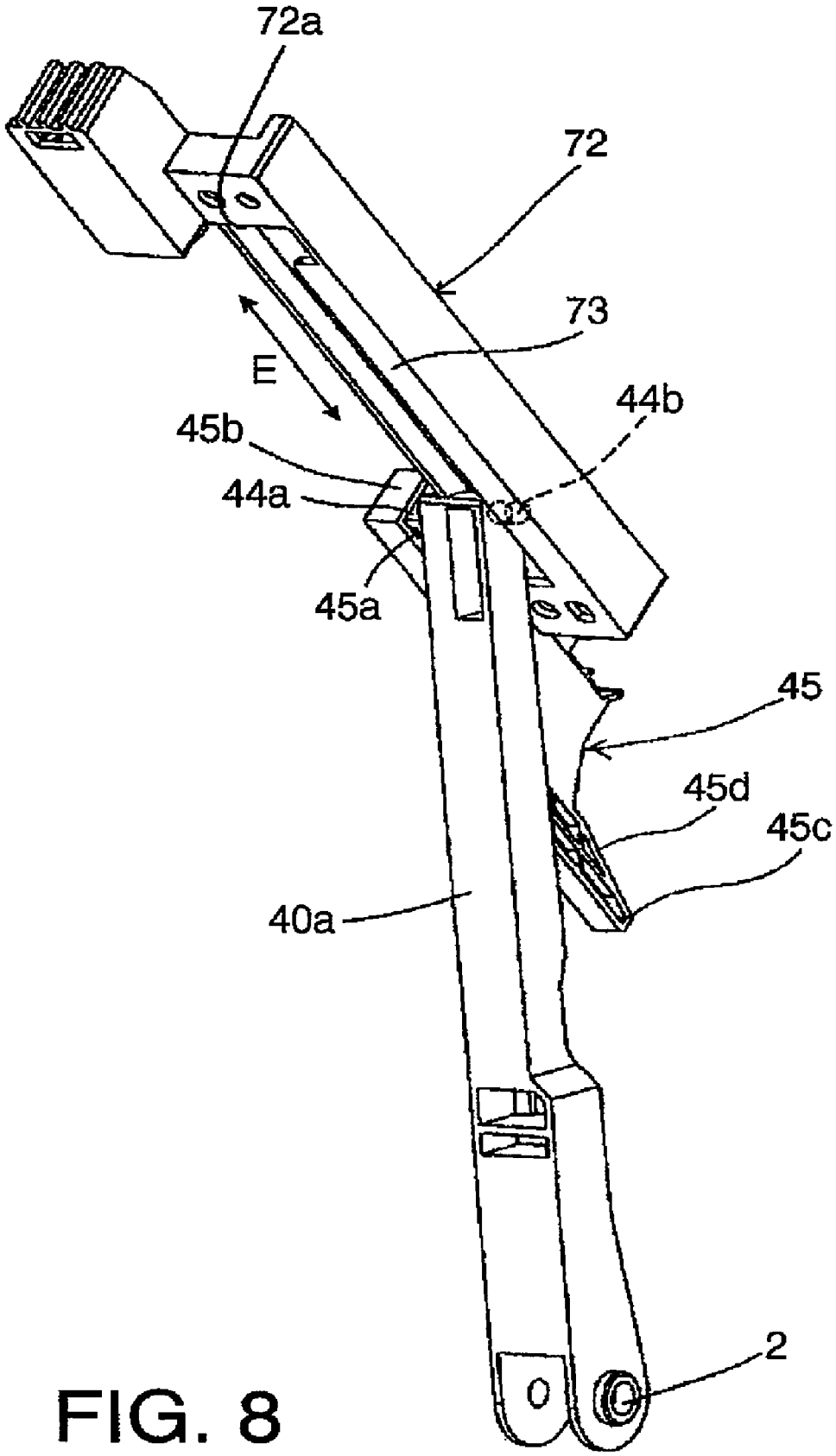

FIG. 8 is a perspective view showing a state where a distal end of the arm is supported by a guide member in the embodiment according to one or more aspects of the present invention.

Figure 9:
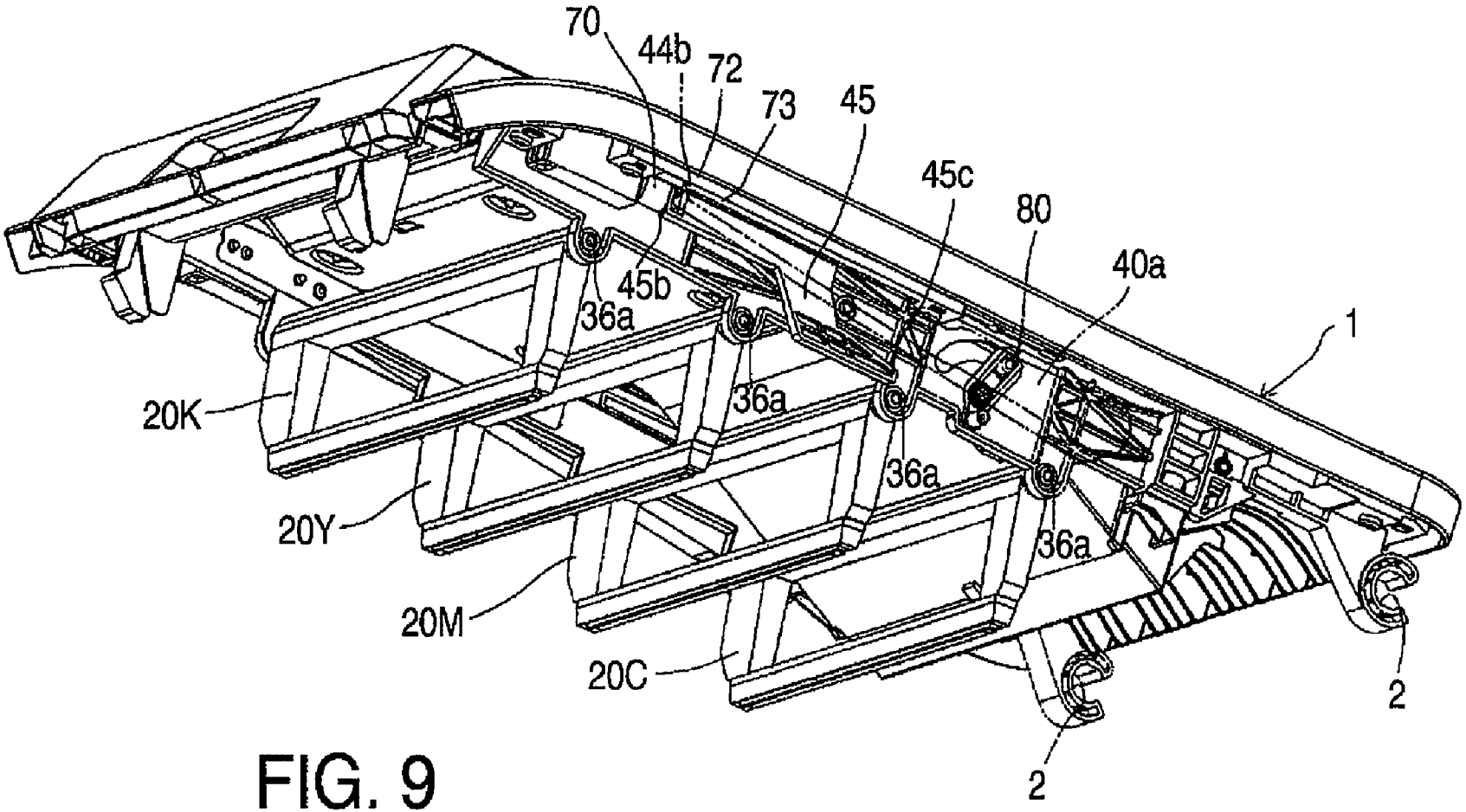

FIG. 9 is a perspective view showing a state where the upper case is closed with respect to a mechanical unit in the embodiment according to one or more aspects of the present invention.

Figure 10:
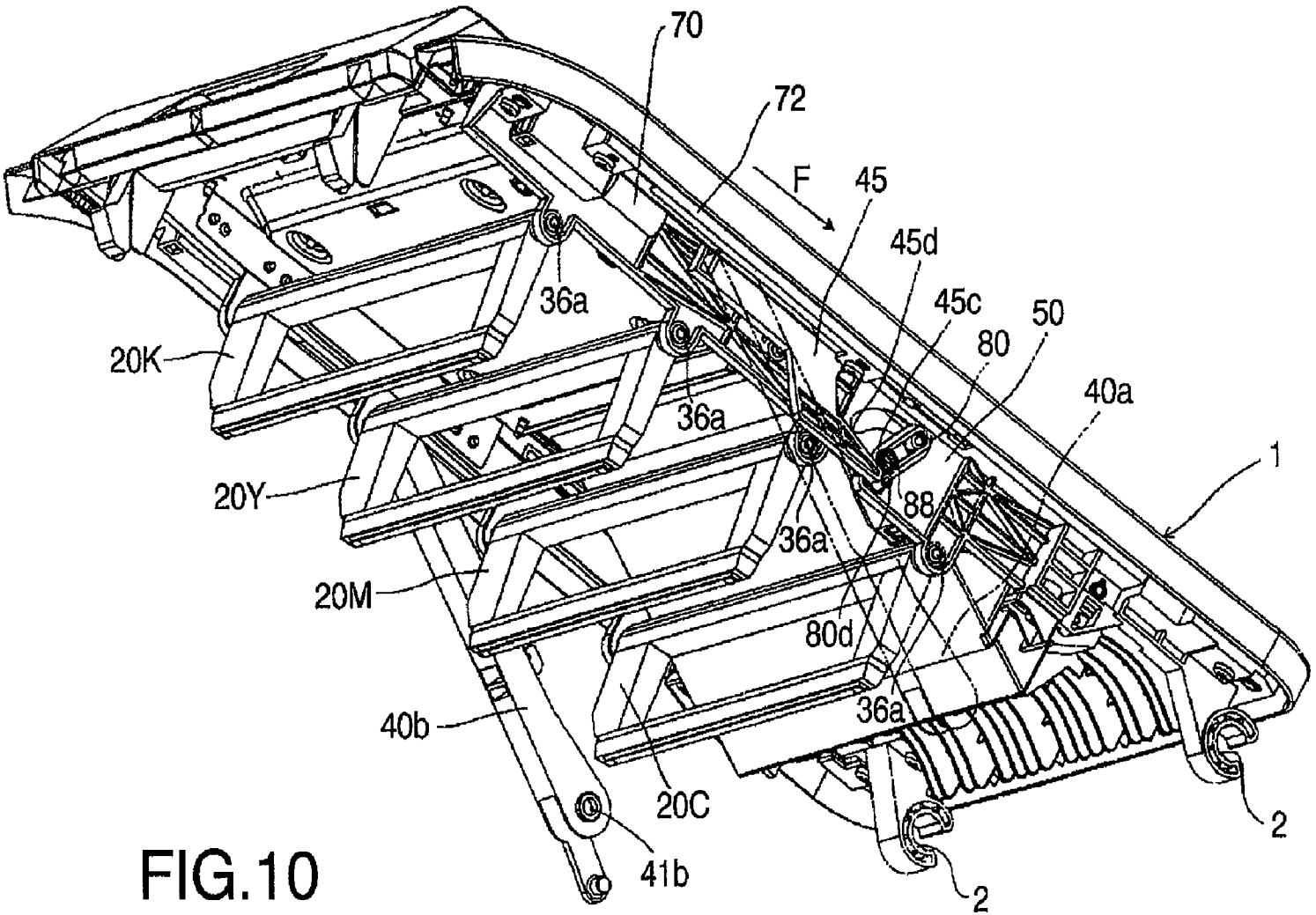

FIG. 10 is a perspective view showing a state where the upper case is slightly opened with respect to the mechanical unit in the embodiment according to one or more aspects of the present invention.

Figure 11:
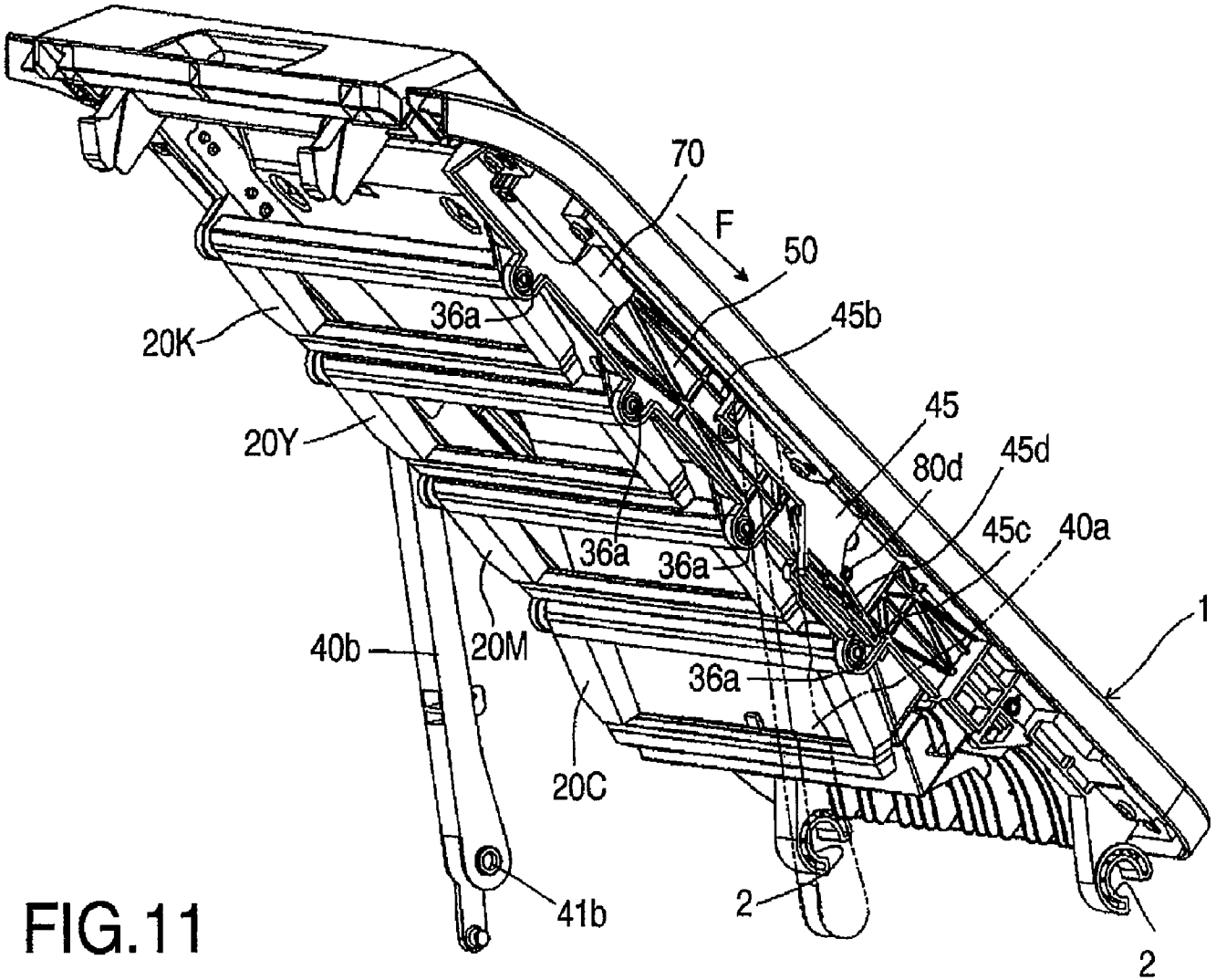

FIG. 11 is a perspective view showing a state where the upper case is completely opened with respect to the mechanical unit in the embodiment according to one or more aspects of the present invention.

Figure 12:
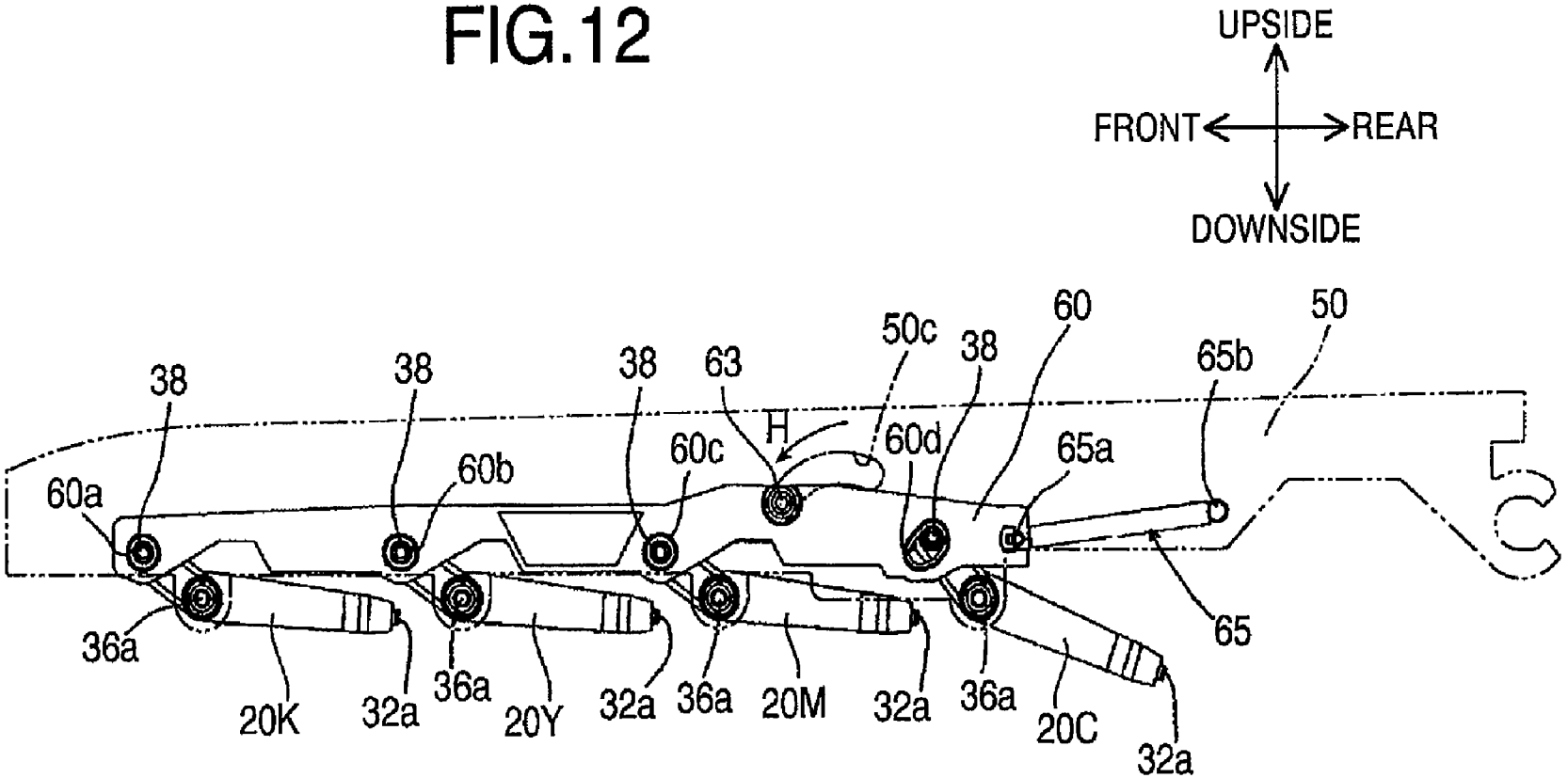

FIG. 12 schematically shows the mechanism for turning the LED unit in the state where the upper case is opened in the embodiment according to one or more aspects of the present invention.

Figure 13:
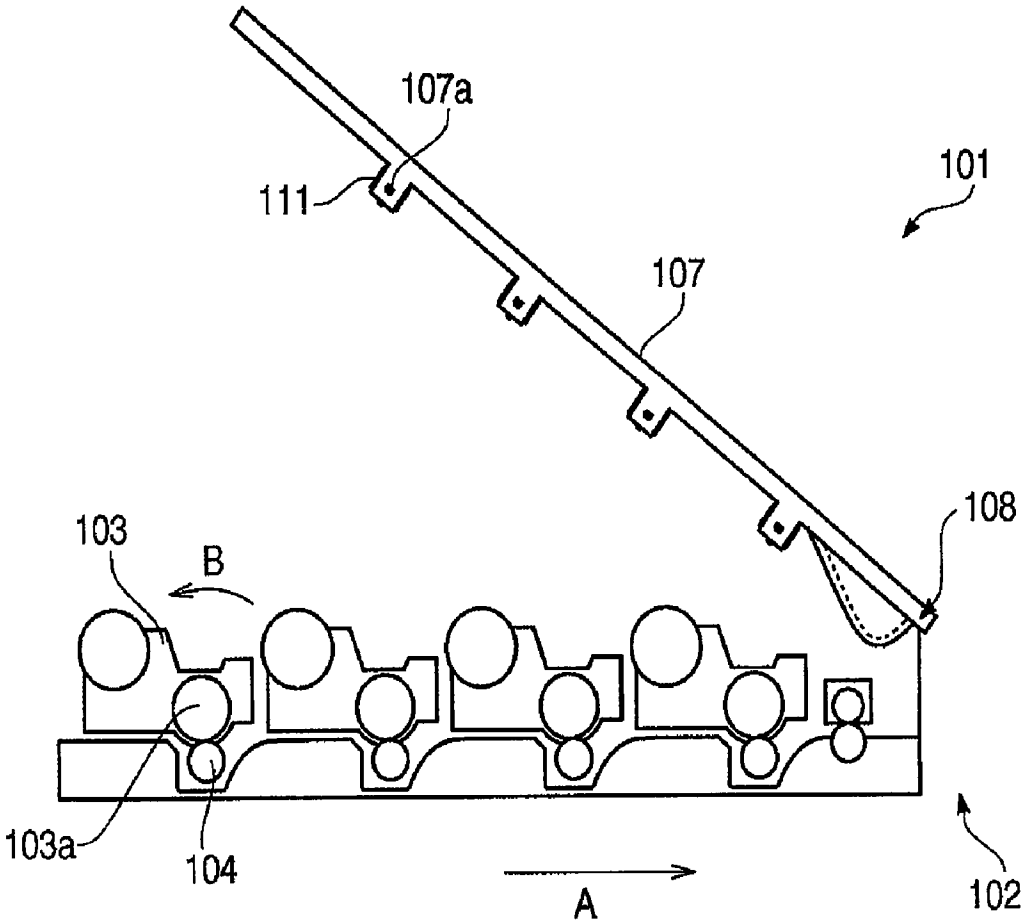
FIG.13 PRIOR ART

FIG. 13 is a cross-sectional side view schematically showing a known LED printer.

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
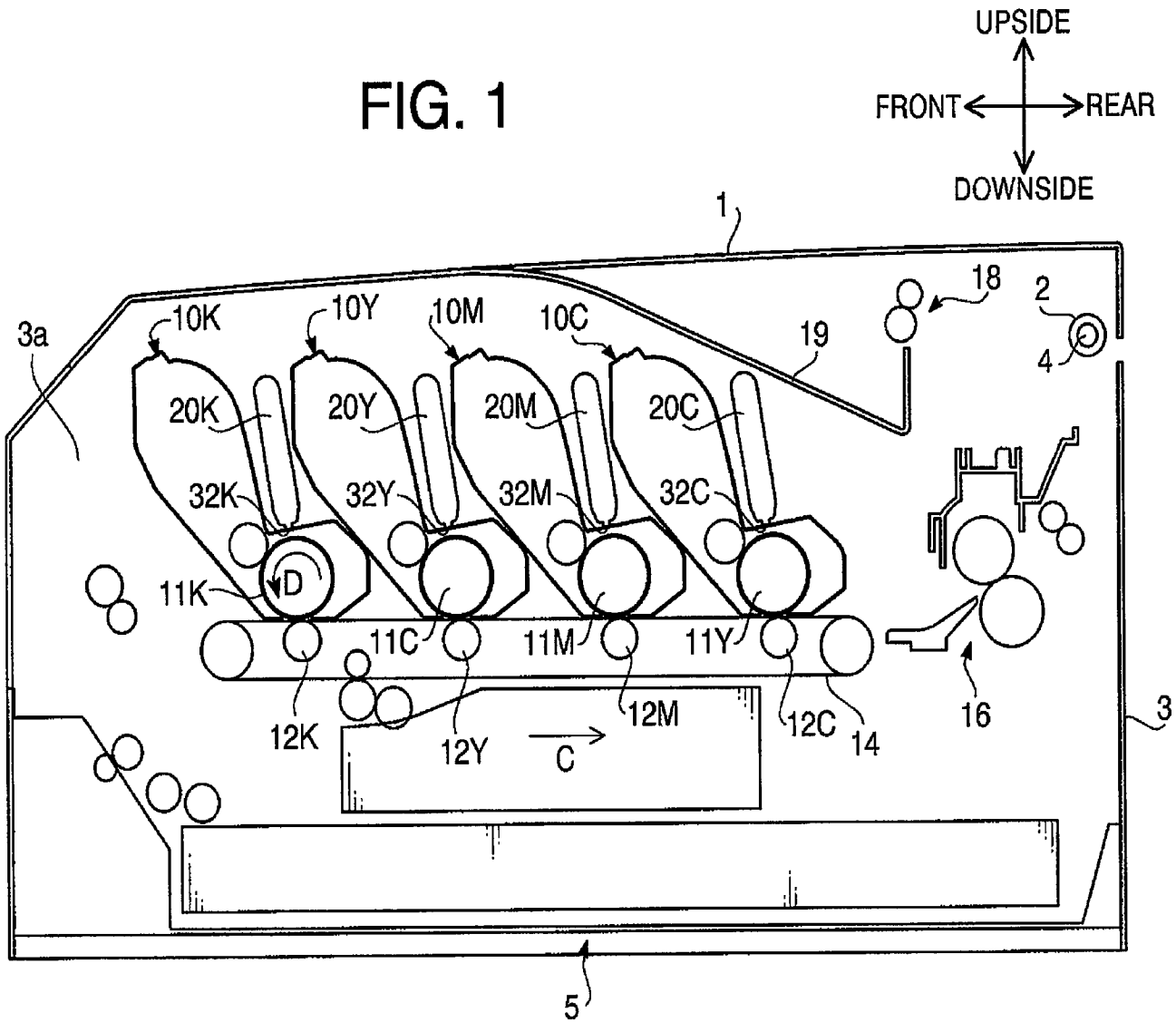
FIG. 1 is a cross-sectional side view schematically showing an entire configuration of an LED printer in a state where an upper case is closed in an embodiment according to one or more aspects of the present invention.

Hereinafter, an embodiment according to aspects of the present invention will be described with reference to the accompany drawings. FIG. 1 is a cross-sectional view schematically showing an entire configuration of an LED printer 5 in an embodiment according to aspects of the present invention. In the LED printer 5 shown in FIG. 1, a left side, a right side, a back side, and a front side on the figure are defined as a front side, a rear side, a left side, and a right side, respectively.

In FIG. 1, an upper case 1 is supported, rotatably with respect to a mechanical unit 3, by a rotational shaft hole 2 provided at a rear side of the upper case 1 and a rotational shaft 4 provided at a rear side of the mechanical unit 3. Further, the mechanical unit 3 has an opening 3*a* at an upper side thereof. It is noted that FIG. 1 shows a state where the upper case 1 is closed with respect to the mechanical unit 3.

In the mechanical unit 3, four drum units 10K, 10Y, 10M, and 10C are detachably disposed that respectively correspond to black (K), yellow (Y), magenta (M), and cyan (C) in an order from an upstream side in a direction of an arrow C denoting a carrying direction of a recording paper.

The drum units 10K, 10Y, 10M, and 10C are provided with photoconductive bodies 11K, 11Y, 11M, and 11C configured to rotate in an arrow D direction, respectively. Images of the predetermined colors are sequentially transferred onto the recording paper, which is conveyed in an arrow C direction while being stuck to a carrying belt 14, by the photoconductive bodies 11K, 11Y, 11M, and 11C in collaboration with transfer rollers 12K, 12Y, 12M, and 12C rotated concurrently with the photoconductive bodies 11K, 11Y, 11M, and 11C. Thereafter, the images of the predetermined colors on the recording paper are thermally fixed with a fixing unit 16. Then, the recording paper is discharged by carrying rollers 18 to a catch tray 19 provided to the upper case 1.

Meanwhile, the upper case 1 includes four LED units 20K, 20Y, 20M, and 20C provided in positions that correspond to circumferential surfaces of the photoconductive bodies 11K, 11Y, 11M, and 11C of the drum units 10K, 10Y, 10M, and 10C, respectively.

LED heads 32K, 32Y, 32M, and 32C (described later) provided at distal ends of the LED units 20K, 20Y, 20M, and 20C are disposed close to the photoconductive bodies 11K, 11Y, 11M, and 11C, respectively, and thereby it is possible to expose the circumferential surfaces of the photoconductive bodies 11K, 11Y, 11M, and 11C. The photoconductive bodies 11K, 11Y, 11M, and 11C are rotated in the arrow D direction and exposed linearly along a right-to-left direction (main scanning direction) thereof.

It is noted that the drum units 10, photoconductive bodies 11, transfer rollers 12, LED units 20, and LED heads 32 in general and, unless specified otherwise, are configured in the same manner, respectively. If it is required to distinguish each element of the same sort of component from the other elements, each element will be distinguished with a reference character (K), (Y), (M), or (C) representing a corresponding color attached thereto.

Figure 2:
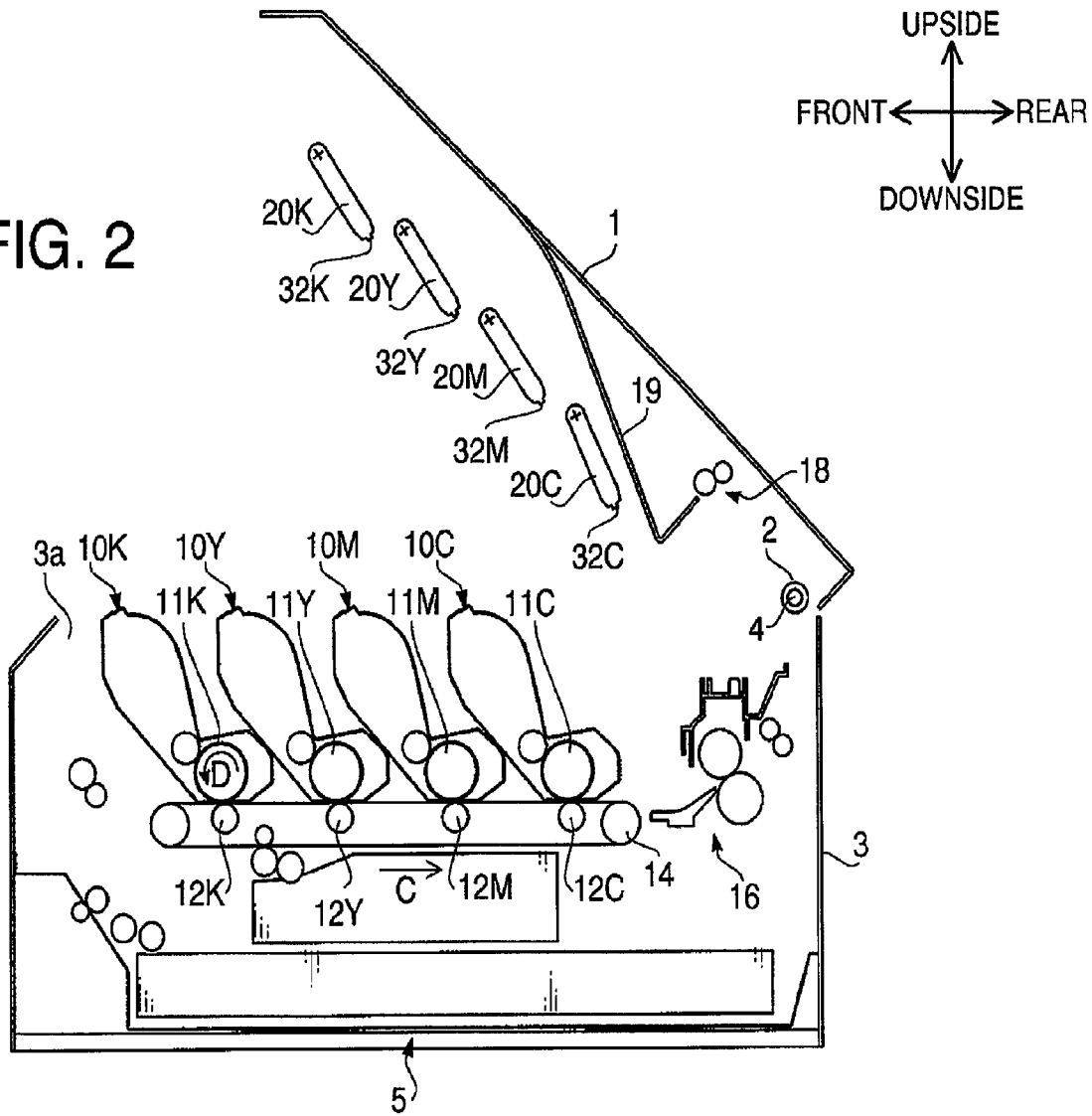
FIG. 2 is a cross-sectional view schematically showing the entire configuration of the LED printer in a state where the upper case is closed in the embodiment according to one or more aspects of the present invention.

FIG. 2 schematically shows a state where the upper case 1 is opened with respect to the mechanical unit 3. When the upper case 1 is opened, the LED unit 20 is turned in conjunction with the upper case 1 so that each of the drum units 10 can be replaced. Hereinafter, referring to FIGS. 3 to 12, a configuration of the LED unit 20 and a mechanism for turning the LED unit 20 in conjunction with the upper case 1 will be described.

Figure 3:
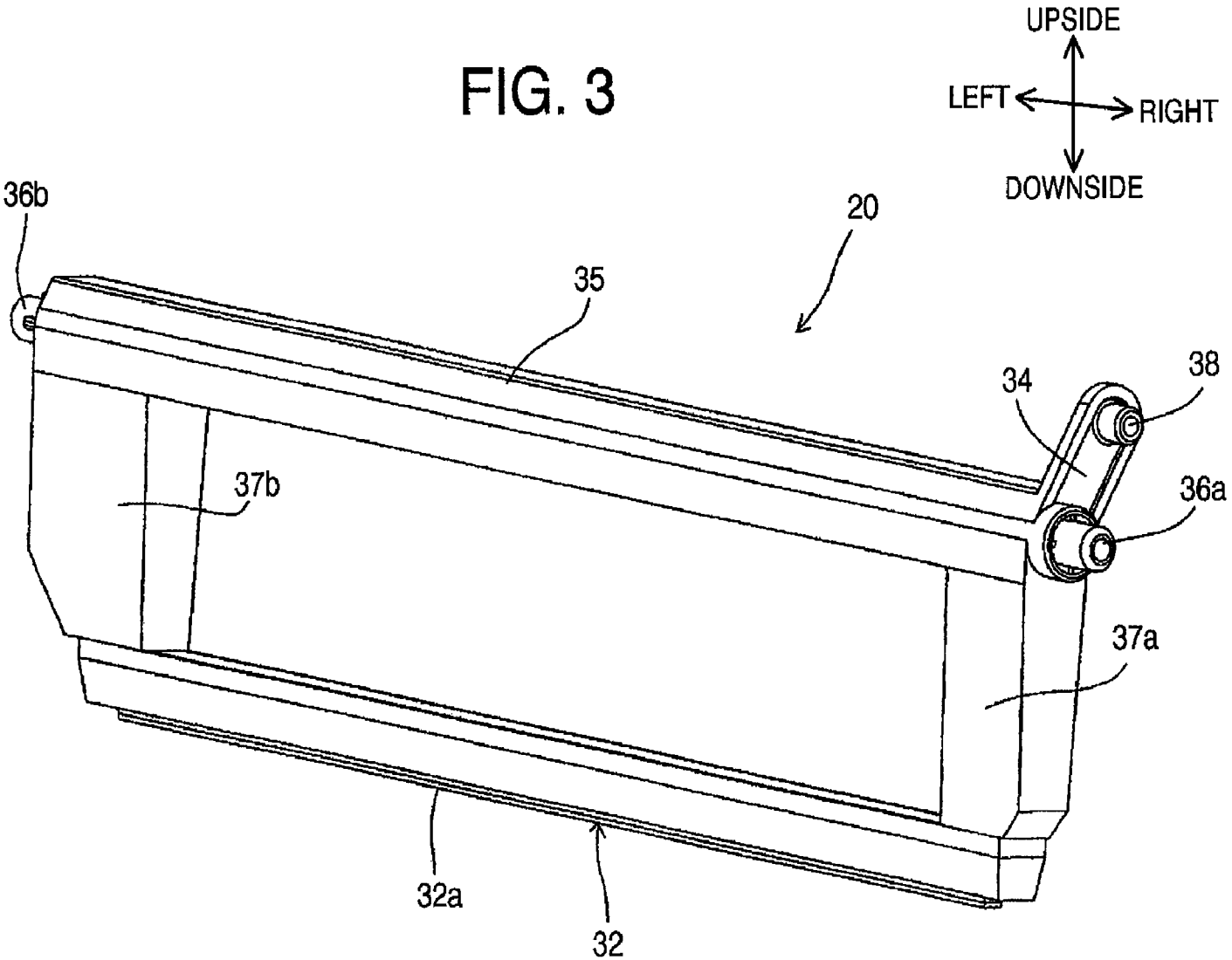
FIG. 3 is a perspective view schematically showing an LED unit in the embodiment according to one or more aspects of the present invention.

FIG. 3 is a perspective view schematically showing the LED unit 20. The LED head 32 provided at a lower portion of the LED unit 20 is configured with an LED array (not shown) of LEDs aligned linearly along the main scanning direction and a Selfoc Lens Array (SLA) (not shown) being integrated. The LED head 32 has an exposure surface 32*a* facing in an illuminating direction of the LED head 32. The LED head 32 is held by holding members 37*a* and 37*b* that extend downward from an LED supporting body 35 elongated in the right-to-left direction.

Additionally, the LED supporting body 35 includes bosses 36*a* and 36*b* each of which protrudes outward along the right-to-left direction. Further, an arm portion 34 extending obliquely upward is provided at a right side end of the LED supporting body 35. A projection 38 that protrudes outward in the same manner as the boss 36*a* is provided in the vicinity of a distal end of the arm portion 34.

Figure 4:
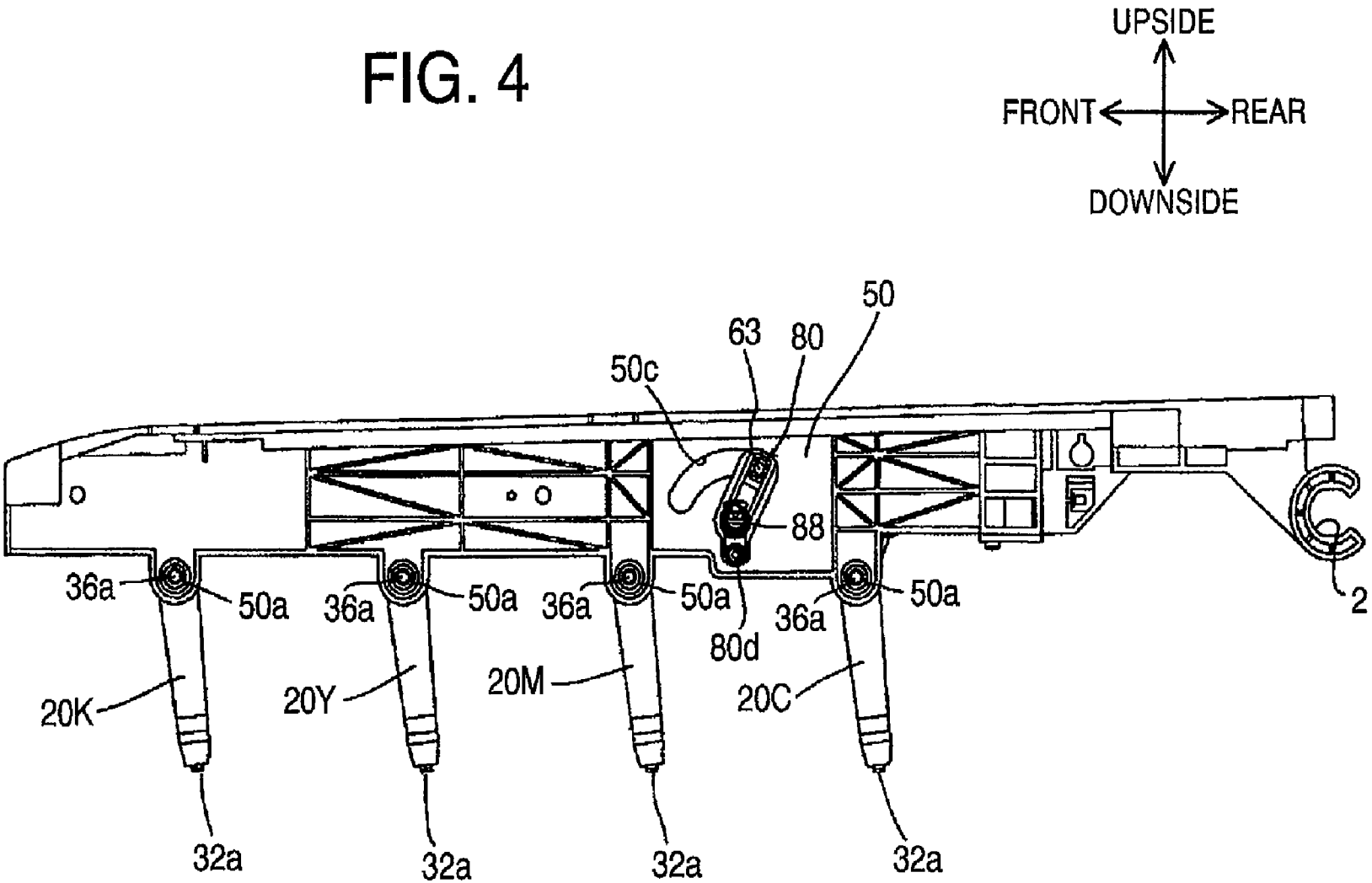
FIG. 4 is a side view schematically showing a state where the LED unit is supported by an LED unit supporting member in the embodiment according to one or more aspects of the present invention.
Figure 5:
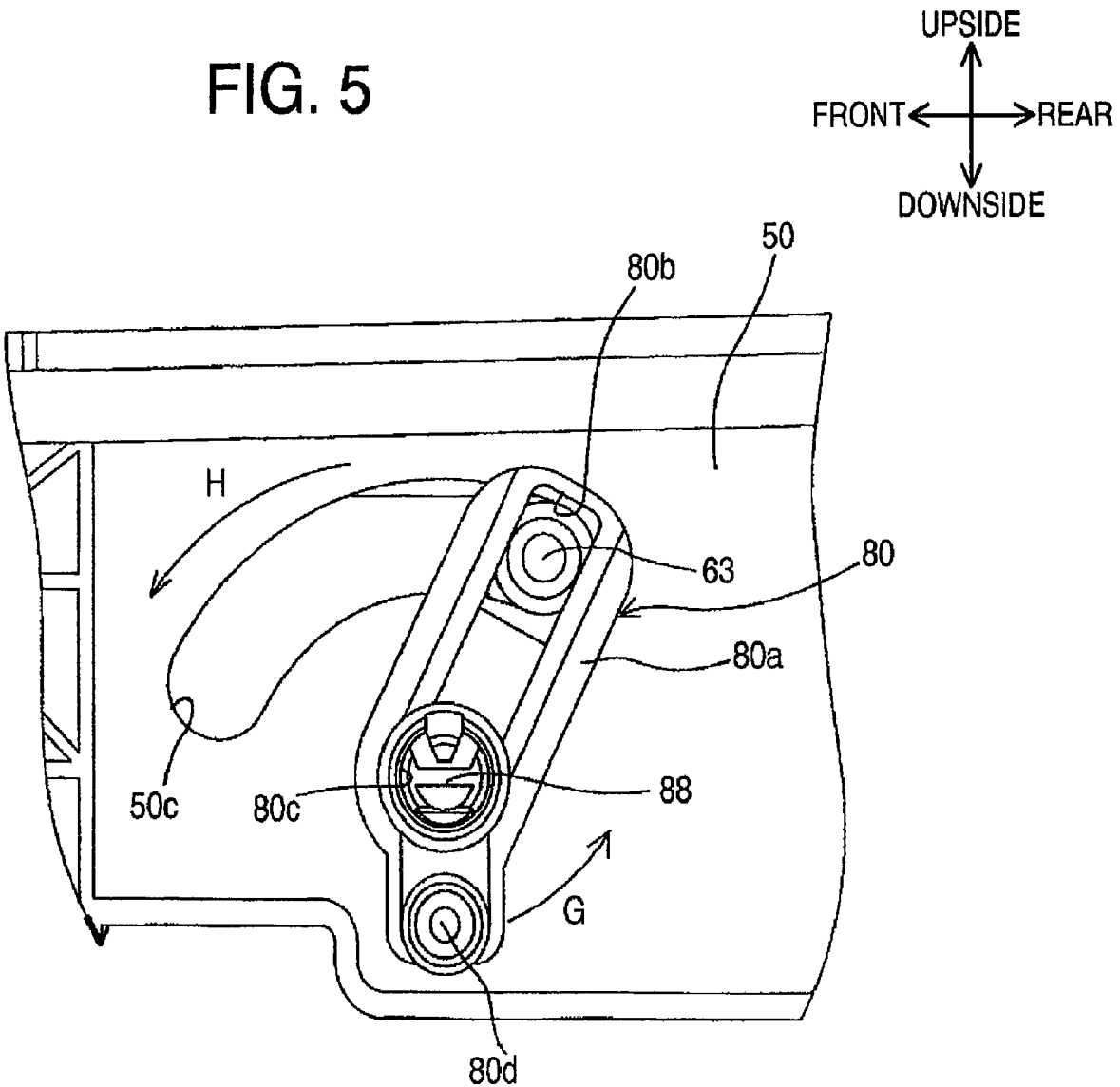
FIG. 5 is an enlarged side view schematically showing a configuration of a lever in the embodiment according to one or more aspects of the present invention.

FIG. 4 is a side view schematically showing a state where the LED unit 20 is supported by an LED unit supporting member 50. FIG. 5 is an enlarged view of a lever 80 shown in FIG. 4. FIG. 6 schematically shows a plate 60 for linking and turning the four LED units 20. FIG. 7 is a perspective view showing a state where the LED unit supporting member 50 is attached to the upper case 1. It is noted that FIG. 7 shows a state where the upper case 1 is opened with respect to the mechanical unit 3 and the mechanical unit 3 is omitted.

As illustrated in FIG. 4, the LED units 20K, 20Y, 20M, and 20C are supported by the LED unit supporting member 50 and aligned in a front-to-rear direction. Specifically, the boss 36*a* of the LED unit 20 is fitted into a hole 50*a* of the LED unit supporting member 50. The LED unit 20 is supported rotatably with respect to the LED unit supporting member 50. It is noted that another LED unit supporting member 50 is provided at a left side of the upper case 1 as well, and the boss 36*b* is fitted into a hole 50*b* of the LED unit supporting member 50 provided at the left side of the upper case 1 (see FIG. 7).

As illustrated in FIGS. 4 and 5, the LED unit supporting member 50 is provided with a curved opening 50*c* penetrating the LED unit supporting member 50 in a circular arc shape and a rotational center boss 88 protruding rightward (toward a front side on the figures). It is noted that the LED unit supporting member 50 provided at the left side of the upper case 1 is not provided with the lever 80, curved opening 50*c*, or rotational center boss 88.

The lever 80 includes a hole 80*c* into which the rotational center boss 88 is fitted, a boss 80*d* located under the hole 80*c*, a rectangle link portion 80*a* extending upward from the hole 80*c* so as to be oblique to a rear side, and a long hole 80*b* formed around a shape of the link portion 80*a*. Further, the lever 80 is configured to turn around the rotational center boss 88.

FIG. 6 indicates the LED unit supporting member 50 shown in FIG. 4 with a chain double-dashed line, and illustrates the plate 60 for linking and turning the four LED units 20. It is noted that FIG. 6 shows the LED unit supporting member 50 at the right side, and the LED unit supporting member 50 at the left side is not provided with the plate 60.

The plate 60 is provided at the left side (back side on FIG. 6) of the LED unit supporting member 50, and has an elongated shape extending in the front-to-rear direction. To a rear end of the plate 60, a spring member 65 is attached as a tension coil spring. A locking portion 65*a* provided at a front end of the spring member 65 is hooked to a rear end of the plate 60, and a locking portion 65*b* provided at a rear end of the spring member 65 is hooked to a part of the LED unit supporting member 50.

Further, the plate 60 is provided with recess portions 60*a*, 60*b*, 60*c*, and 60*d*, into which the respective projections 38 of the four LED units 20K, 20Y, 20M, and 20C are loosely fitted. Additionally, the plate 60 is provided with a protrusion 63, which protrudes rightward (toward the front side on FIG. 6) from the curved opening 50*c* of the LED unit supporting member 50. Further, the protrusion 63 is fitted into the long hole 80*b* of the lever 80 (FIG. 4).

As illustrated in FIG. 7, between the upper case 1 and the mechanical unit 3, a pair of arms 40*a* and 40*b* is provided. In addition, between the arms 40*a* and 40*b* and the mechanical unit 3, tension coil springs 42*a* and 42*b* are provided from a vicinity of centers of the arms 40*a* and 40*b* toward the rear side, respectively.

Cylindrical members 41*a* and 41*b* respectively provided at lower portions of the arms 40*a* and 40*b* are turnably fitted around a shaft (not shown) of the mechanical unit 3. In addition, a distal end of the arm 40*a* is configured to slide along an arrow E direction with respect to a guide member 72 attached to the upper case 1. Further, another guide member 72 is provided at the left side of the upper case 1, and a distal end of the arm 40*b* is as well configured to slide with the left guide member 72.

It is noted that the upper case 1 maintains the state opened with respect to the mechanical unit 3 in FIG. 7. In this case, the arms 40*a* and 40*b* support the upper case 1, and the arms 40*a* and 40*b* are biased backward (i.e., toward the rear side) by the tension coil spring 42*a* and 42*b*. Thereby, the upper case 1 maintains the opened state while the distal ends of the arms 40*a* and 40*b* are left in a stationary state.

FIG. 8 is a perspective view showing the arm 40*a* and guide member 72 shown in FIG. 7. Further, FIG. 8 shows a moving member 45 moving in conjunction with the arm 40*a*. At the distal end of the arm 40*a*, a cylindrical protruded portion 44*a* is provided to protrude leftward, while a cylindrical protruded portion 44*b* (indicated by a dashed line) is provided on the right side of the cylindrical protruded portion 44*a* via the arm 40*a*. The protruded portion 44*b* is supported by a guide plate 73 of the guide member 72, and configured to move along the guide plate 73 in the front-to-rear direction (i.e., along the arrow E direction).

In addition, the protruded portion 44*a* is fitted into a rectangular hole 45*a* of the moving member 45. The moving member 45 is provided to slide along the arrow E direction with respect to the upper case 1, and configured to move in conjunction with sliding along the arrow E direction of the distal end of the arm 40*a*. Further, the moving member 45 includes a pressing portion 45*c* provided at a rear end thereof, and a tilted portion 45*d* extending toward an upper front side from the pressing portion 45*c*. Meanwhile, a distal end of the arm 40*b* is configured to slide with respect to the left guide member 72 in the same manner as the arm 40*a*, yet not provided with the moving member 45.

Next, referring to FIGS. 9 to 11, how the upper case 1 is opened and closed with respect to the mechanical unit 3 and how the LED unit 20 is turned in conjunction with the opening and closing of the upper case 1 will be described in detail. It is noted that, FIGS. 9 to 11, the arm 40*a* is denoted by a chain double-dashed line in a clearly understandable manner, and the tension coil springs 42*a* and 42*b* are not shown. FIG. 9 shows a state where the upper case 1 is closed with respect to the mechanical unit 3. In FIG. 10, the upper case 1 is slightly opened, and in FIG. 11, the upper case 1 is completely opened.

When the upper case 1 is closed with respect to the mechanical unit 3 as shown in FIG. 9, the LED unit 20 is disposed substantially perpendicular to the upper case 1 so as to expose the photoconductive body 11.

Further, the arms 40*a* and 40*b* are disposed substantially parallel to the upper case 1. In this case, the protruded portion 44*b* of each of the arm 40*a* and 40*b* is disposed in the vicinity of a front end of the guide plate 73. Further, the upper case 1 is provided with a damper 70 configured with a compression coil spring. The damper 70 is pressed by a side face 45*b* of the moving member 45 moving in conjunction with the arm 40*a*. Namely, the upper case 1 is stationary while the damper 70 is compressed.

It is noted that another damper 70 is provided at the left side of the upper case 1, and more specifically, provided at a front end 72*a* of the left guide member 72. When the upper case 1 is set to the closed state from the opened state, the side face 45*b* of the moving member 45 at the right side and the distal end of the arm 40*b* at the left side come into contact with the dampers 70, respectively. Therefore, it can be avoided that the upper case 1 is closed with great force.

When the upper case 1 is slightly opened as shown in FIG. 10, the upper case 1 is turned around the rotational shaft 4, and in conjunction with it, the distal ends of the arms 40*a* and 40*b* slide backward (in an arrow F direction) along the guide member 72. It is noted that the protruded portion 44*a* fitted into the rectangle hole 45*a* of the moving member 45 is provided at the distal end of the arm 40*a*, and thus the moving member 45 slides backward (i.e., toward the rear side) in conjunction with the movement of the distal end of the arm 40*a*.

When the moving member 45 slides backward, the pressing portion 45*c* at the rear end of the moving member 45 comes into contact with the boss 80*d* of the lever 80. When the upper case 1 is further opened from the above state, the moving member 45 slides further backward (see FIG. 11). At this time, when the moving member 45 slides backward, the boss 80*d* is pressed by the pressing portion 45*c* of the moving member 45 and thereafter pressed by the tilted portion 45*d*. This movement causes the boss 80*d* to turn in an arrow G direction. When the boss 80*d* is turned in the arrow G direction shown in FIG. 5, the link portion 80*a* is turned in an arrow H direction.

When the link portion 80*a* is turned in the arrow H direction, the protrusion 63 is concurrently turned. When the protrusion 63 is turned in the arrow H direction, as illustrated in FIG. 12, the plate 60 is moved forward (i.e., toward the front side) around the bosses 36*a* against an elastic force of the spring member 65. Further, at this time, the LED units 20K, 20Y, 20M, and 20C are turned backward around the respective bosses 36*a*. When the LED unit 20 is turned, the exposure surface 32*a* is directed toward a rotational center of the upper case 1. It is noted that, when the boss 80*d* is pressed by the pressing portion 45*c*, the boss 80*d* is turned in the arrow G direction while receiving a resistance force from the tilted portion 45*d*. Thereby, it can be avoided that the LED unit 20 is rapidly turned.

In addition, a turned angle of the LED unit 20C is smaller than those of the LED units 20K, 20Y, and 20M. This is because the recessed portion 60*d* for the LED unit 20C into which the projection 38 of the LED unit 20C is fitted is not circular but substantially oval oblique backward. When the plate 60 moves forward, the LED units 20K, 20Y, and 20M are turned around the respective bosses 36*a*. Meanwhile, the LED unit 20C is turned around the boss 36*a*, yet at this time, the projection 38 moves relatively toward an upper rear side along the substantially oval recessed portion 60*d*. Thereby, the tilt angle of the LED unit 20C with respect to the upper case 1 is larger than those of the LED units 20K, 20Y, and 20M.

Further, the catch tray 19 provided at the upper portion of the LED unit 20 is formed to extend in a rear-to-front direction in a manner curved upward (see FIGS. 1 and 2). Since the four LED units 20 are attached along the form of the catch tray 19, the LED unit 20C at the rearmost side is provided with the greatest tilt angle with respect to the upper case 1. It is noted that the tilt angles of the LED units 20 to the upper case 1 in the present embodiment have a relationship of 20C>20K=20Y=20M.

Further, while the upper case 1 is turned from the state shown in FIG. 9 to the state shown in FIG. 10, the LED units 20 maintain the state substantially perpendicular to the upper case 1. During this period, the LED units 20 are on the way to being got out of the mechanical unit 3 in conjunction with the upper case 1. At this time, the LED units are disposed in the vicinity of the respective drum units 10, and therefore the LED units 20 are required to be got out of the mechanical unit 3 so as not to contact the drum units 10. FIG. 10 shows a state where the LED units 20 are completely got out of the mechanical unit 3. When the upper case 1 is further opened from this state, the LED units 20 are turned.

Thus, when the upper case 1 is opened, the exposure surfaces 32*a* of the LED units 20 are directed toward the rotational center of the upper case 1. Therefore, the exposure surfaces 32*a* are not exposed to an open side of the upper case 1. Hence, the exposure surfaces 32*a* are hardly touched by a user, and thus can be prevented from being damaged or tainted with dust adhered thereto.

Further, since all the LED units 20 are turned when the upper case 1 is opened, the drum units 10 can easily be replaced without having to widely open the upper case 1. Thereby, since the upper case 1 does not have to be widely opened with respect to the mechanical unit 3, the LED printer 5 can be prevented from being fallen down.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention. Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An image forming device, comprising:

a first device body having an opening;

a second device body having a first side end and a second side end opposite to the first side end, the first side end being rotatably joined with the first device body, the second side end being configured to turn around the first side end between an opened state where the second device body is opened with respect to the first device body and a closed state where the second device body is closed with respect to the first device body so as to cover the opening;

a photoconductive body provided in the first device body;

an exposure unit provided to the second device body, the exposure unit having an exposure surface configured to expose a surface of the photoconductive body linearly in a predetermined scanning direction and form a latent image on the surface of the photoconductive body;

an exposure unit turning mechanism configured to turn the exposure unit between an exposure position where the exposure surface is directed to the surface of the photoconductive body in the closed state of the second device body and an evacuation position where the exposure surface is directed substantially to the first side end of the second device body in the opened state of the second device body; and an arm provided between the first device body and the second device body, the arm being configured to support the second device body and the exposure unit, when the second device body is at the opened state, wherein the exposure unit is interlocked with the arm, and wherein the exposure unit turns between the exposure position and the evacuation position in conjunction with movement of the arm.

2. The image forming device according to claim 1, wherein the arm includes a first end and a second end opposite to the first end, wherein the first end of the arm is rotatably joined with the first device body, wherein the second end of the arm is joined with the second device body to turn around the first end and slide with respect to the second device body along a sliding direction from the first side end to the second side end of the second device body, wherein the second end of the arm is located at a side of the second side end of the second device body in the closed state of the second device body, wherein the second end of the arm is located at a side of the first side end of the second device body in the opened state of the second device body, and wherein the exposure unit turning mechanism turns the exposure unit between the exposure position and the evacuation position in conjunction with sliding of the second end of the arm.

3. The image forming device according to claim 2, wherein the second device body includes a damper configured to contact one of the second end of the arm and a member moving along with the second end of the arm when the second device body comes to the closed state from the opened state.

4. The image forming device according to claim 1, wherein the second device body includes a sheet output tray configured to receive a sheet that is carried in a sheet output direction from the first side end to the second side end of the second device body, wherein the sheet output tray is formed to extend in the sheet output direction in a manner curved upward, and wherein the exposure unit includes a plurality of exposure units aligned in the sheet output direction along the form of the sheet output tray under the sheet output tray.

5. An image forming device comprising:

a first device body having an opening;

a second device body having a first side end and a second side end opposite to the first side end, the first side end being rotatably joined with the first device body, the second side end being configured to turn around the first side end between an opened state where the second device body is opened with respect to the first device body and a closed state where the second device body is closed with respect to the first device body so as to cover the opening;

a photoconductive body provided in the first device body;

an exposure unit provided to the second device body, the exposure unit having an exposure surface configured to expose a surface of the photoconductive body linearly in a predetermined scanning direction and form a latent image on the surface of the photoconductive body;

an exposure unit turning mechanism configured to turn the exposure unit between an exposure position where the exposure surface is directed to the surface of the photoconductive body in the closed state of the second device body and an evacuation position where the exposure surface is directed substantially to the first side end of the second device body in the opened state of the second device body; and an arm provided between the first device body and the second device body, the arm including a first end and a second end opposite to the first end, wherein the first end of the arm is rotatably joined with the first device body, wherein the second end of the arm is joined with the second device body to turn around the first end and slide with respect to the second device body along a sliding direction from the first side end to the second side end of the second device body, wherein the second end of the arm is located at a side of the second side end of the second device body in the closed state of the second device body, wherein the second end of the arm is located at a side of the first side end of the second device body in the opened state of the second device body, wherein the exposure unit turning mechanism turns the exposure unit between the exposure position and the evacuation position in conjunction with sliding of the second end of the arm, wherein the exposure unit turning mechanism includes:

a moving member configured to move along with the second end of the arm; and a lever configured to be rotated when a portion thereof is pressed by the moving member moving along with the second end of the arm in the opened state of the second device body, and wherein the exposure unit turning mechanism turns the exposure unit to the evacuation position in conjunction with rotation of the lever in the opened state of the second device body.

6. The image forming device according to claim 5, wherein the exposure unit includes a plurality of exposure units aligned along the sliding direction, wherein the exposure unit turning mechanism includes a plate configured to link the plurality of exposure units and move substantially along the sliding direction in conjunction with the rotation of the lever so as to turn the plurality of exposure units between the exposure positions and the evacuation positions, respectively, and wherein the exposure unit turning mechanism turns the plurality of exposure units to the respective evacuation positions by the plate moving in conjunction with the rotation of the lever in the opened state of the second device body.

* * * * *

UNITED STATES PATENT AND TRADEMARK OFFICE

CERTIFICATE OF CORRECTION

PATENT NO. : 7,991,325 B2
APPLICATION NO. : 12/233780
DATED : August 2, 2011
INVENTOR(S) : Takuya Yamaguchi It is certified that error appears in the above-identified patent and that said Letters Patent is hereby corrected as shown below:

Title Page item 54, and col. 1

Title:
Please delete "ROTATABY" and insert -- ROTATABLY --

Signed and Sealed this
Third Day of January, 2012

David J. Kappos

David J. Kappos
*Director of the United States Patent and Trademark Office*